US006973807B2

(12) United States Patent
Bruske et al.

(10) Patent No.: US 6,973,807 B2
(45) Date of Patent: Dec. 13, 2005

(54) TIP-HEADED NEEDLE

(75) Inventors: Johannes Bruske, Albstadt (DE); Günther Büchle, Bad Waldsee (DE); Stephan Pfister, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/897,103

(22) Filed: Jul. 23, 2004

(65) Prior Publication Data

US 2005/0016221 A1 Jan. 27, 2005

(30) Foreign Application Priority Data

Jul. 24, 2003 (DE) ..... 103 33 656

(51) Int. Cl.[7] ..... D04B 35/02
(52) U.S. Cl. ..... 66/116; 28/115
(58) Field of Search ..... 66/116–120; 28/107, 28/115; 163/1, 2; 112/222

(56) References Cited

U.S. PATENT DOCUMENTS

| | | | | |
|---|---|---|---|---|
| 1,709,631 A | * | 4/1929 | Schmidt | 66/117 |
| 1,983,536 A | * | 12/1934 | Carlson | 66/117 |
| 3,134,248 A | * | 5/1964 | Kubelka et al. | 66/125 R |
| 3,253,426 A | * | 5/1966 | Mauersberger | 66/84 R |
| 3,309,900 A | * | 3/1967 | Wunsch et al. | 66/85 A |
| 3,417,580 A | * | 12/1968 | Scholtis et al. | 66/120 |
| 3,646,780 A | * | 3/1972 | Wildeman | 66/85 A |
| 3,646,781 A | * | 3/1972 | Scholtis et al. | 66/85 A |
| 3,754,693 A | | 8/1973 | Herr | |
| 3,760,607 A | * | 9/1973 | Wildeman | 66/85 A |
| 6,206,256 B1 | | 3/2001 | Marzocchi | |

FOREIGN PATENT DOCUMENTS

| | | |
|---|---|---|
| DD | 290 028 A5 | 5/1991 |
| DE | 40 38 936 A1 | 6/1991 |
| DE | 42 06 842 A1 | 9/1993 |
| DE | 43 44 375 C1 | 1/1995 |
| DE | 195 19 671 A1 | 12/1996 |

* cited by examiner

*Primary Examiner*—Danny Worrell
(74) *Attorney, Agent, or Firm*—Fitch, Even, Tabin & Flannery; Norman N. Kunitz; George H. Spencer

(57) ABSTRACT

A stitch needle (10) is provided with a tip (29) which is shaped as a center punch and has no recognizable rounding at its terminus (31). The tip (29) is preferably arranged at mid height of the hook-shaped aperture (36) which is structured for capturing the yarn (13). The particular shape of the tip (29) and its positioning minimize the wear of the stitch needle (10) and also minimize damages to the yarn (13).

18 Claims, 3 Drawing Sheets

10
23
26
27
28
29
31
32
33
34
35
36
38
39
41
42
43
44
45
46
47
L
B
B1
B2
R
VI
VII

TIP-HEADED NEEDLE

CROSS REFERENCE TO RELATED APPLICATIONS

This application claims the priority of German Patent Application No. 103 33 656.7, filed on Jul. 24, 2003, the subject matter of which, in its entirety, is incorporated herein by reference.

BACKGROUND OF THE INVENTION

The invention relates to a tip-headed needle which belongs to the needle group of stitch needles and is particularly adapted for use in the stitch-bonding technology for working on technical textile materials.

Technical textiles or other textile materials are frequently manufactured by stitch-bonding in which a backing or other flat textile fabric is pierced through, and subsequently a yarn to be captured by the needle is pulled through the backing. In the field of technical textile materials such backings are frequently made of carbon fibers' ceramic fibers or glass fibers, or they contain such fibers.

Conventional stitch needles are, as a rule, provided with a "ball tip", that is, the needle tip is spherically curved with a greater or lesser radius. The tip radius depends from the application of the needles. The ball tip is intended to avoid piercing of the yarns to thus prevent the backing from being damaged.

It has been found that such known stitch needles, when used for piercing technical textiles, significantly damage the backing after a short service, and, in most cases, even cause damage at the beginning of the process. The extent of such damage increases as the operating period lengthens. Tests have shown that the cause of the damage lies in the rapid and substantial wear of the tip of the stitch needles.

Sewing needles have various tip configurations, dependent upon the purpose of such needles. Thus, apart from needles having spherical tips, needles with cone-shaped "punch tips" are known. Such a needle, which is illustrated in FIGS. 9 and 10, is adapted for working on film-like synthetic materials, coated fabrics and shirt material. The known sewing needle 1 shown in FIG. 9 has at its tip a "punch" 2 of conical shape, whose lateral surface is linear or outwardly convex. The conical tip of the needle 1 pushes apart the filaments of the backing to be pierced without damaging the carrier fabric or adversely affecting the strength of the cover layer proper. The sewing needle 1 further has a needle body 7 as well as an eye 8 passing transversely therethrough. The needle body 7 has a circular cross section at least in the region of the eye. Further, a short yarn trough 9 may adjoin the eye 8.

The above outlined sewing needles are not adapted for use in stitch-bonding.

SUMMARY OF THE INVENTION

It is an object of the invention to improve a stitch needle for obtaining a longer life expectancy therefor.

The above object generally is achieved according to the present invention by a needle that has an has an elongated needle body provided with an aperture for receiving a yarn, a holding portion at one end and a tip region formed as a punch tip at the opposite end. The needle body tapers in the direction of the tip region such that its two flat sides converge in an acute angle. It is feasible to provide that the acute angle has a constant magnitude throughout the entire wedge-shaped region. The tip or the tip region is thus formed as a "punch tip" which has a conical or pyramidal shape and whose opening angle is preferably greater than the earlier-noted acute angle. The opening angle may be constant or may vary along the length of the punch tip. The punch tip has no appreciable rounding radius or a rounding radius intentionally provided within manufacturing tolerances. Rather, the tip is considered as having a pointed end as concerns manufacturing accuracy. It has been found that with such a stitch needle even difficult technical textile materials which consists of, or contain, carbon fibers or mineral fibers or other abrasive materials may be processed without damaging the material to be pierced by the needle and without causing an excessive wear of the needle during the working process. It has further been found that the piercing force can be reduced up to 50% and more. In an actual embodiment the piercing force for a sharply pointed stitch needle according to the invention could be reduced from 0.9 N to 0.5 N.

It has further been found that stitch needles having a punch tip, sufficiently and permanently shift the backing laterally during pierce-through to ensure that during the return stroke of the needle, the yarn, captured by a hook-like aperture in the needle, can be pulled through the backing without generating an excessive friction with the pierced hole as the latter re-closes. As a result, damages to the yarn to be pulled through the backing during the process are avoided even if the backing contains aggressive fibers, such as carbon fibers, ceramic fibers, glass fibers or the like. Although the service life of the needle is substantially extended by providing a punch tip and thereby damages to the backing by worn needle tips are avoided, the pierced holes are, as before, opened in such a manner that during the return stroke of the stitch needle they remain open with a sufficient width to ensure a low-friction pull-through of the yarn entrained by the stitch needle. This result is achieved without any damage to the backing.

Further details of advantageous embodiments are described and defined.

It is considered to be particularly advantageous to arrange the tip of the needle body such that a line which extends parallel to the length of the needle body and which passes through the tip, intersects the unilaterally open, hook-like aperture substantially at mid depth. This arrangement brings the center of the pierced hole into alignment with the yarn to be pulled through. This applies in particular when the hook-shaped aperture lies in a needle body region whose width (the distance between the flat sides of the needle body) is substantially less at the tip-side end of the aperture than in the shank region. The shank region is situated in a zone where the flat sides of the needle body extend parallel to one another.

It is feasible to provide the punch tip with a circular cross section or, in the alternative, with a polygonal cross section. The size of the punch tip preferably corresponds to the size of the spherical tip of a conventional stitch needle; however, it is not purposefully provided with a radius within finishing tolerances. In case a rounding of the tip is present, its radius R is preferably less than one tenth of the height or width of the stitch needle in the region of the foot of the punch tip.

Further advantageous details of embodiments of the invention may be obtained from the drawing, the specification and the claims.

BRIEF DESCRIPTION OF THE DRAWINGS

The drawing illustrates embodiments of the invention as well as the prior art, wherein.

DETAILED DESCRIPTION OF THE INVENTION

Figure 1:
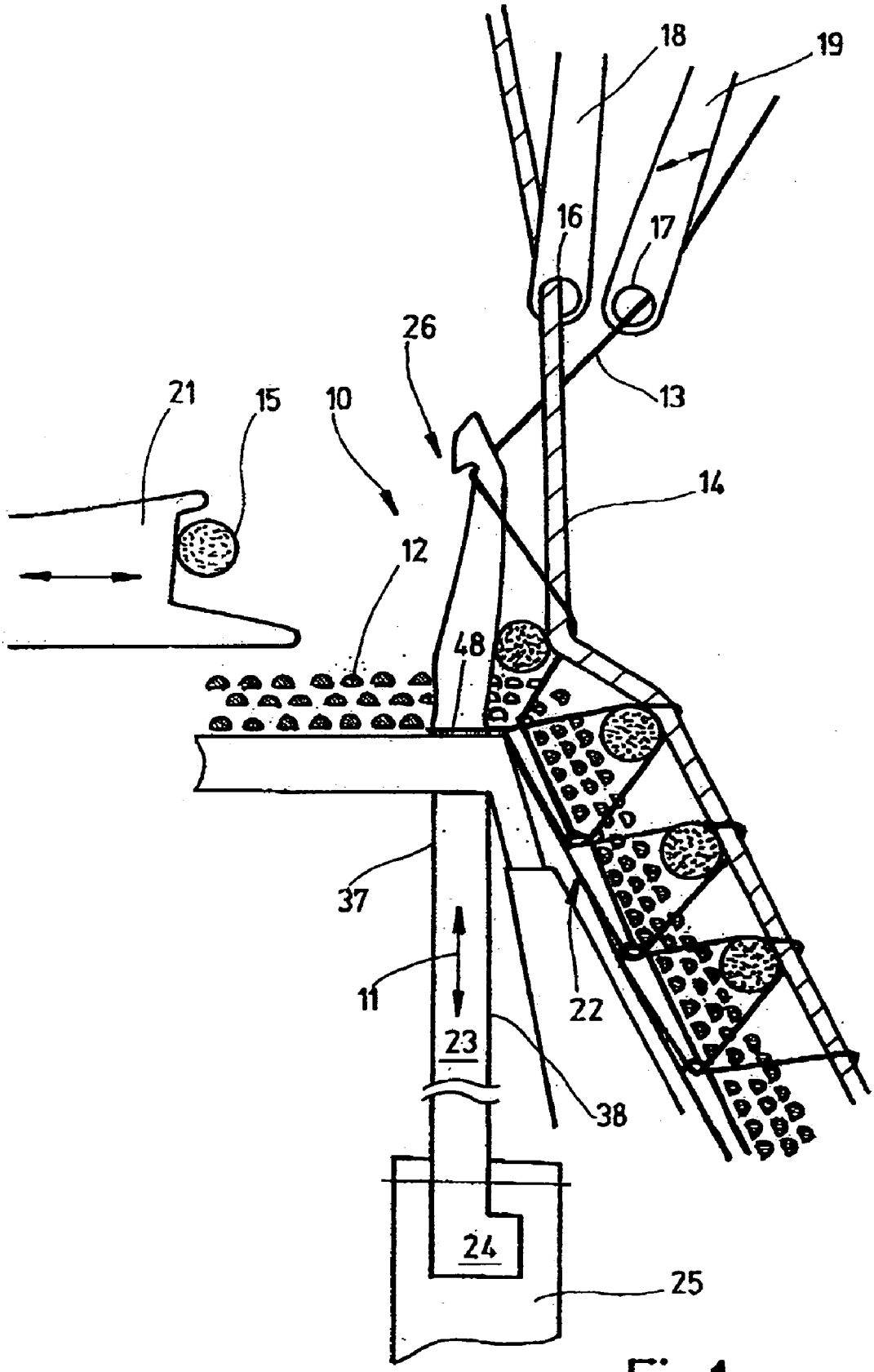
FIG. 1 shows, in a basic, schematic illustration, a stitch needle performing a stitch-bonding process.

FIG. 1 illustrates a stitch needle 10 which belongs to a stitch-bonding machine or a multi-axial warp-forming machine. The stitch needle 10 is, together with identically structured further stitch needles, secured to a common needle bar. The stitch needles are simultaneously reciprocated in their longitudinal direction as shown by the arrow 11. The purpose of the stitch needles is to reinforce a backing 12 by means of a yarn 13. The backing may be made, for example, of carbon fibers, synthetic fibers, natural fibers, mineral fibers, or may be a nonwoven, random-fiber material, a fabric or a knitted material. In particular, the backing may be a technical textile material, that is, a textile product used for purposes other than apparel. The yarns 14, 15 serve as ground and weft yarns, whereas the yarn 13 serves as a sewing yarn or warp yarn which fixes, sews, or stitches together the ground yarns and weft yarns. The yarns 13, 14 run through eyes 16, 17 of respective guide needles which, together with identically structured other guide needles 18, 19 may be secured to a guide needle bar. A further yarn carrier or weft yarn introducer 21 has the purpose of presenting in the working zone the yarns 15 which are oriented transversely to the stitch needles 10. The apparatus shown in FIG. 1 is operated in a manner known by itself: the yarn of each stitch needle 10 produces a binding which loops around the yarns 14, 15 and holds them against the backing 12. The loops 22 of the respective bindings lie underneath the backing 12.

The particularity of the apparatus according to FIG. 1 resides in the configuration of the stitch needle 10, especially in the shape of its upper end cooperating with the yarn 13 and the backing 12. In this connection reference is made to FIGS. 2 and 3 which separately show a part of the stitch needle 10. The stitch needle 10 has a needle body 23 which, as illustrated in FIG. 1, has an elongated shank. The shank is provided with a holding device 24 for attachment to an only schematically shown needle bar 25. At the opposite end of the shank or needle body 23 a needle head 26 is provided which is separately illustrated in FIGS. 2 and 3. The needle head 26 is, similarly to the shank 23, bounded by two flat sides 27, 28 which are parallel to one another in the region of the shank 23 and which form with one another an acute angle of, for example, 10? in the region of the needle head 26. The flat sides 27, 28 are formed as planar surfaces both in the region of the shank 23 and in the region of the needle head 26. The flat sides 27, 28 converge into a tip 29 which is configured as a punch tip. The tip 29 has an approximately point-like terminus 31 and a transition or foot 32 which constitutes a transitional location 33. The side portions 34, 35 which adjoin the terminus 31 and which belong to the flat sides 27, 28, adjoin the transitional location 33 with a bend or kink. The side portions 34, 35 form with one another an acute angle which is greater than the acute angle formed by the remaining flat sides 27, 28. By virtue of such a construction, the acute angle viewed from the terminus 31 changes its magnitude between the flat sides 27, 28 at the transitional location 33.

The width B measured at the transitional location 33 is one third to one fourth of the width B1 in the region of an aperture 36 of the stitch needle 10. Further, the width B1 is approximately one half of the width B2 which defines the distance between the flat sides 27, 28 in the region of the shank 23.

The tip 29 is further detailed in FIGS. 4 to 8.

Figures 2, 3, 4, 5, 6, 7, 8:
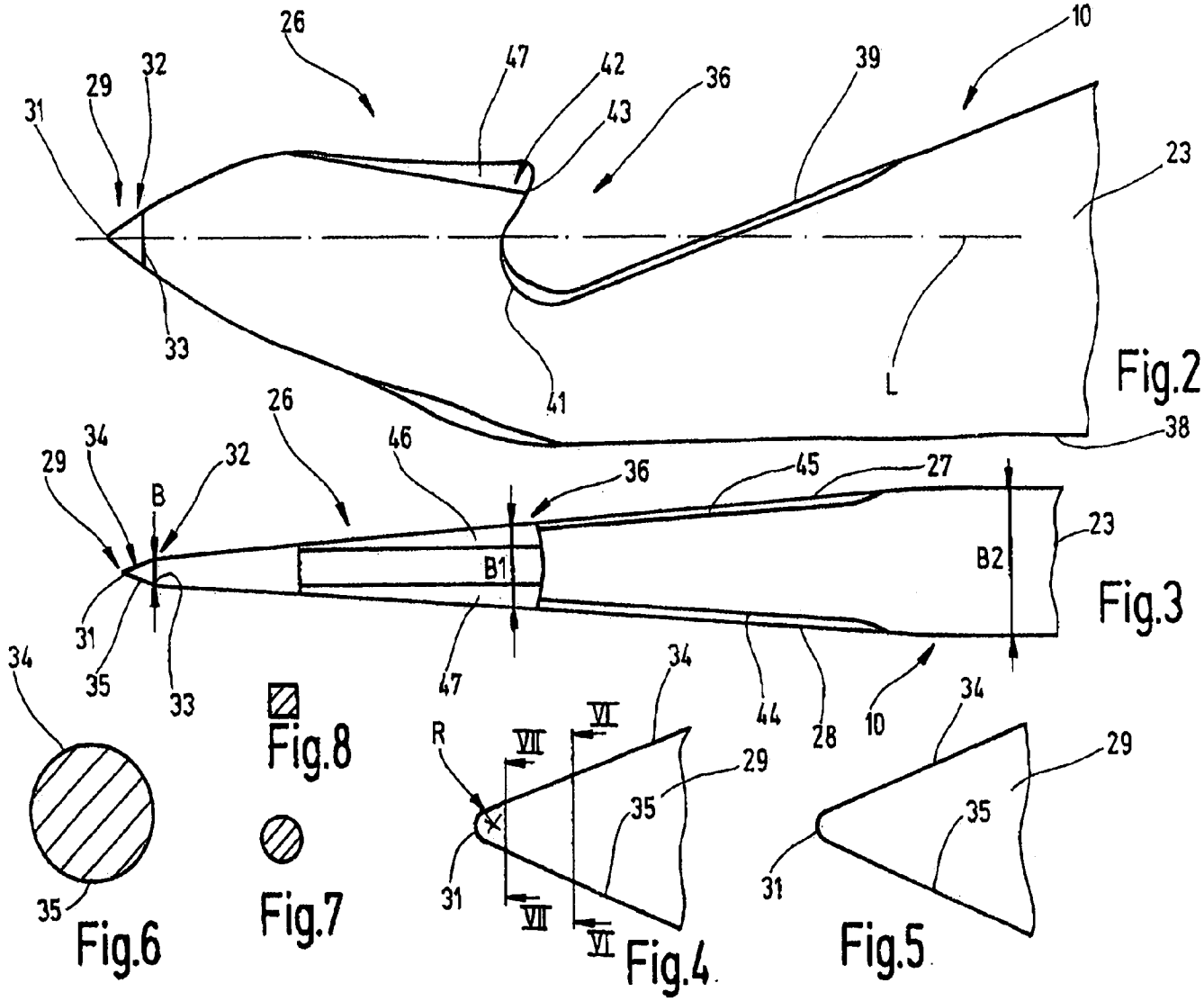
FIG. 2 is a fragmentary side elevational view of the stitch needle of FIG. 1 at a different scale.
FIG. 3 is a fragmentary schematic top plan view of the stitch needle of FIG. 2.
FIG. 4 shows the punch tip of the stitch needle of FIGS. 1 to 3 in an extremely enlarged, idealized representation.
FIG. 5 shows the punch tip of FIG. 4 in an extremely enlarged, less idealized representation.
FIG. 6 is a sectional view along line VI—VI of the punch tip of FIG. 4.
FIG. 7 is a sectional view along line VII—VII of the punch tip of FIG. 4.
FIG. 8 is a sectional view along line VII—VII of a punch tip shown in FIG. 4, according to an alternative embodiment.
Figure 10:
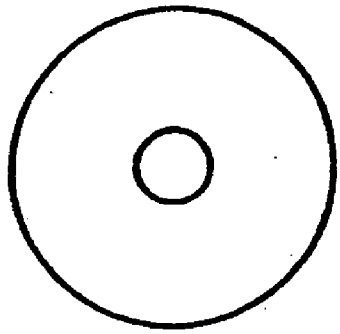
FIG. 9 is a fragmentary side elevational view of a sewing needle according to the prior art and FIG. 10 shows the sewing needle of FIG. 9 as viewed in the direction of the needle tip.
Figure 9:
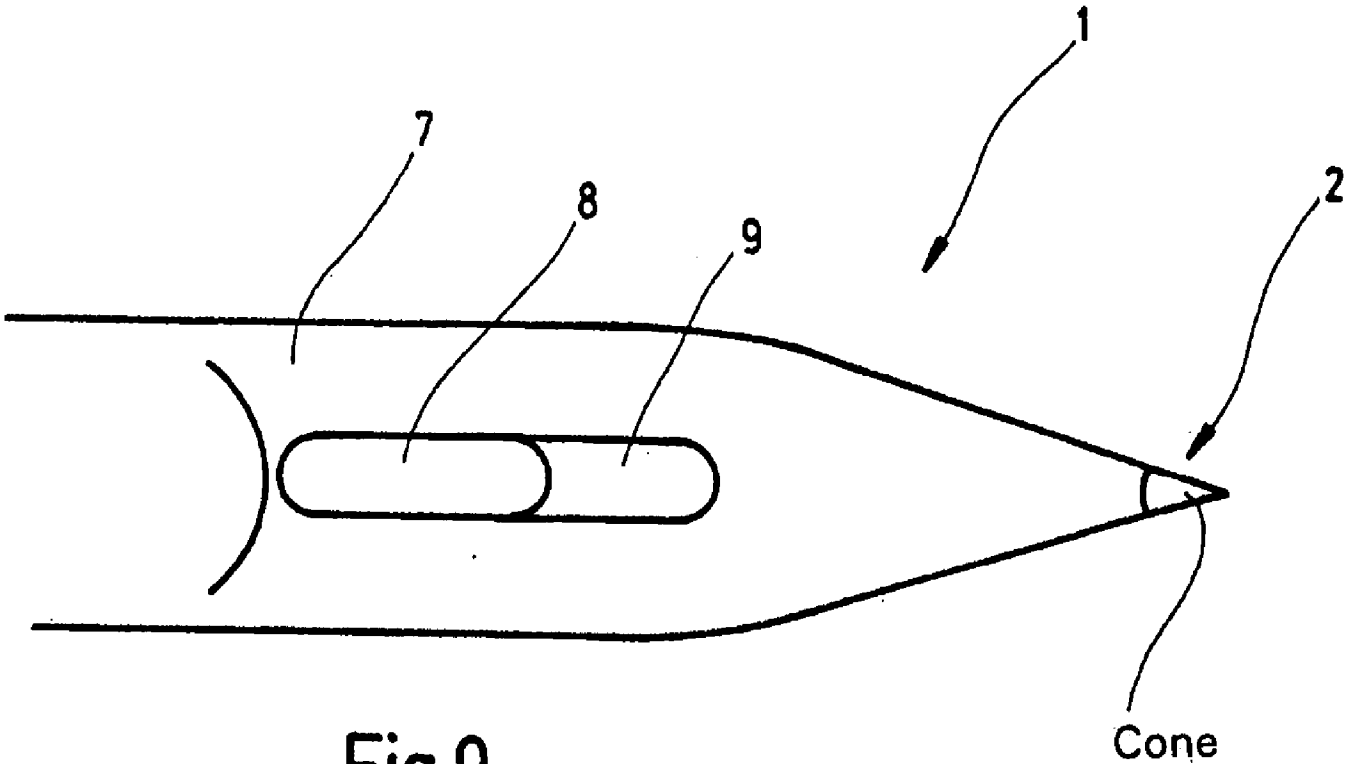

As noted earlier, the terminus 31 is manufactured essentially as a point, that is, without an intentional rounding. FIG. 4 illustrates one part of the tip 29 in a very significant magnification (more than ten times compared to FIG. 3). The side portions 34, 35 intersect one another at the tip. The rounding radius R at the terminus 31 is less than one tenth of the width B at the foot 32 of the tip 29. While FIG. 4 shows the tip 29 in a geometrically idealized form, FIG. 5 shows the shape of the frontal terminus 31 of the tip 29 as seen under electron microscopic magnification. The side portions 34, 35 have a certain finish-related roughness, as a result of which the tip 29 deviates at the terminus 31 from the ideal point shape to the extent of such roughness. In FIG. 4 the deviation is shown as the radius R.

The tip 29, formed as a conical tip, has a circular cross section as shown in FIG. 6. In the alternative, such cross section may be polygonal with rounded corners. Thus, for example, the cross section may be quadratic or rectangular. The cross section of the tip 29 changes toward the terminus 31 into a quadratic cross section as shown in FIG. 8 (note section line VII—VII) or into a circular cross section as shown in FIG. 7 (note again section line VII—VII).

The earlier-noted aperture 36 is hook-shaped. A lead-in surface 39 which is preferably linear in side view, extends in the region of the needle head 26 from an upper needle surface 37 which is oriented parallel to a lower needle surface 38 in the region of the shank 23 and which extends parallel to the needle length. The lead-in surface 39 runs into the aperture 36 where it changes into a nose 42 by means of a rounding 41. As seen in FIGS. 2 and 3, the lead-in surface 39 is provided with a rounding 44, 45 toward the flat sides 27, 28. A short, essentially linear flat piece 43 adjoins the rounding 41 in the region of the nose 42.

A line L which intersects the terminus 31 of the tip 29 and which is parallel to the length dimension of the stitch needle 10, intersects the aperture 36 approximately at mid height, that is, underneath a location where facets 46, 47 provided on the nose 42 border the flat piece 43.

The above-described stitch needle 10 operates as follows:

In the stitch-bonding process illustrated in FIG. 1 the stitch needle 10 periodically pierces through the backing 12 which contains abrasive material, such as carbon fibers. During the piercing step, the tip 29 pushes the fibers aside.

Particularly in case the fibers are monofilaments, there is practically no risk that they are pierced by the tip 29. During the piercing step the stitch needle 10 penetrates into the backing 12 to such an extent until the shank passes through the opened pierced hole and the needle head 26 grasps a loop of the yarn 13. During the reverse stroke of the stitch needle 10 the yarn 13 is pulled through the backing and through a loop 48 already situated on the shank 23. The successive loop 48 on the shank will be formed in this manner from the yarn loop which is pulled through the backing when the stitch needle pierces through the backing 12 anew.

The particular shape and position of the tip 29 result in an only slight needle wear and further result in such an opening of the pierced hole that a pull-through of the yarn 13 with only slight yarn wear is taking place. It is to be noted that the stitch needle 10 may be a slider needle which is provided (or cooperates) with a slider. The slider serves for a purposeful, controlled opening and closing of the hook.

An stitch needle 10 is provided with a tip 29 which is shaped as a punch and has no recognizable rounding at its terminus 31. The tip 29 is preferably arranged at mid height of the hook-shaped aperture 36 which is structured for capturing the yarn 13. The particular shape of the tip 29 and its positioning minimize the wear of the stitch needle 10 and also minimize damages to the yarn 13.

LIST OF REFERENCE CHARACTERS

1 sewing needle
2 punch tip
7 needle body
8 eye
9 yarn trough
10 stitch needle
11 arrow/longitudinal direction
12 backing
13, 14, 15 yarns
16, 17 eye
18, 19 guide needles
21 yarn carrier
22 stitch
23 shank, needle body
24 holding device
25 bar
26 needle head
27, 28 flat sides
29 tip
31 terminus
32 foot, transition
33 transitional location
34, 35 side portions
36 aperture
37 upper needle surface
38 lower needle surface
39 lead-in surface
41 rounding
42 nose
43 flat piece
44, 45 rounding
46, 47 facets
48 loop
B, B1, B2 width
R radius
L line

What is claimed is:

1. A stitch needle for stitch-bonding technology, comprising an elongated needle body which has an aperture for receiving a yarn and which further has, at one end, a holding device and a pointed terminus at the opposite end and which also has two flat sides which converge at an acute angle toward the terminus; and the acute angle has, where it adjoins the terminus, a first magnitude which changes into a smaller, second magnitude at a transitional location which is remote from the terminus; and wherein the needle body has, between the terminus and the transitional location, a cross section formed of a polygon having rounded corners, with the cross section increasingly approaching a circular cross section toward the terminus.

2. The stitch needle as defined in claim 1, wherein the transitional location where the first magnitude changes into the second magnitude of the acute angle, is situated between the aperture and the terminus.

3. The stitch needle as defined in claim 1, wherein the flat sides intersect one another at the terminus.

4. The stitch needle as defined in claim 1, wherein the terminus has no rounding radius within manufacturing tolerances.

5. The stitch needle as defined in claim 1, wherein the terminus has a rounding radius (R) which, as measured at the transitional location, is less than 1/10 of the distance between the flat sides.

6. The stitch needle as defined in claim 1, wherein the needle body has an upper needle surface and a lower needle surface intersecting one another at the terminus.

7. The stitch needle as defined in claim 1, wherein the needle body has a rectangular cross section.

8. The stitch needle as defined in claim 1, wherein the terminus of the needle body lies on a center line (L) which extends parallel to the length dimension of the needle body and which intersects the aperture essentially at mid depth.

9. The stitch needle as defined in claim 1, wherein the aperture is a hook aperture.

10. The stitch needle as defined in claim 1, wherein the needle body has a polygonal cross section between the terminus and the transitional location.

11. A stitch needle comprising an elongated needle body that has an aperture for receiving a yarn and that further has a holding device at one end and a pointed terminus at the opposite end and that also has two flat sides that converge at an acute angle toward the terminus; and the acute angle has, where it adjoins the terminus, a first magnitude which changes into a smaller, second magnitude at a transitional location that is remote from the terminus; and wherein the needle body has a polygonal cross section between the terminus and the transitional location, and this polygonal cross section increasingly approaches a circular cross section toward the terminus.

12. The stitch needle as defined in claim 11, wherein the transitional location where the first magnitude changes into the second magnitude of the acute angle, is situated between the aperture and the terminus.

13. The stitch needle as defined in claim 11, wherein the flat sides intersect one another at the terminus.

14. The stitch needle as defined in claim 11, wherein the terminus has a rounding radius (R) that, as measured at the transitional location, is less than 1/10 of the distance between the flat sides.

15. The stitch needle as defined in claim 11, wherein the needle body has an upper needle surface and a lower needle surface that intersect one another at the terminus.

16. The stitch needle as defined in claim 11, wherein the needle body has a rectangular cross section.

17. The stitch needle as defined in claim 11, wherein the terminus of the needle body lies on a center line (L) that extends parallel to the length dimension of the needle body and that intersects the aperture essentially at mid depth.

18. A stitch needle for stitch-bonding technology, comprising an elongated needle body which has an aperture for receiving a yarn and which further has, at one end, a holding device and a pointed terminus at the opposite end and which also has two flat sides which converge at an acute angle toward the terminus; and the acute angle has, where it adjoins the terminus, a first magnitude which changes into a smaller, second magnitude at a transitional location which is remote from the terminus; and wherein the terminus has a rounding radius (R) which, as measured at the transitional location, is less than 1/10 of the distance between the flat sides.

* * * * *